US009816712B2

(12) United States Patent
Mochizuki et al.

(10) Patent No.: US 9,816,712 B2
(45) Date of Patent: Nov. 14, 2017

(54) OUTDOOR UNIT AND AIR-CONDITIONING APPARATUS

(71) Applicant: Mitsubishi Electric Corporation, Tokyo (JP)

(72) Inventors: Tatsuya Mochizuki, Tokyo (JP); Yoshihiro Tanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 492 days.

(21) Appl. No.: 14/458,836

(22) Filed: Aug. 13, 2014

(65) Prior Publication Data

US 2015/0075203 A1 Mar. 19, 2015

(30) Foreign Application Priority Data

Sep. 13, 2013 (JP) ..... 2013-190653

(51) Int. Cl.
*F25D 21/06* (2006.01)
*F24F 1/20* (2011.01)
(Continued)

(52) U.S. Cl.
CPC ..... *F24F 1/20* (2013.01); *F24F 1/06* (2013.01); *F24F 1/46* (2013.01); *F24F 11/0086* (2013.01); *F24F 13/22* (2013.01); *F24F 2011/0054* (2013.01); *F24F 2011/0087* (2013.01); *F24F 2013/221* (2013.01); *F24F 2221/34* (2013.01); *F25B 2313/008* (2013.01); *F25B 2313/029* (2013.01)

(58) Field of Classification Search
CPC ..... F24F 2011/0089; F24F 1/20; F24F 1/06; F24F 1/46; F24F 11/086; F24F 13/22; F24F 2011/0054; F24F 2011/0087; F24F 2013/221; F24F 2221/34; F25B 2313/0294; F25B 2400/01; F25B 2313/008; F25B 2313/029
USPC ..... 62/275
See application file for complete search history.

(56) References Cited

U.S. PATENT DOCUMENTS 3,091,944 A * 6/1963 Miner ..... F25B 13/00 62/159
3,833,839 A * 9/1974 Debaigt ..... H05K 7/1417 361/748
(Continued)

FOREIGN PATENT DOCUMENTS

JP 1957175968 U * 5/1981
JP S57-175968 U 5/1981
(Continued)

OTHER PUBLICATIONS

Yokomizo, JPO Decision of Rejection, dated May 26, 2016.*
(Continued)

*Primary Examiner* — Melvin Jones
(74) *Attorney, Agent, or Firm* — Posz Law Group, PLC

(57) ABSTRACT

An outdoor unit includes a casing having a bottom plate and is configured such that at least a part thereof is made of metal, a compressor provided within the casing to compress a flammable refrigerant, an outdoor heat exchanger provided within the casing to exchange heat between the refrigerant and outside air, and an electric heater provided on an upper surface of the bottom plate. The power consumption of the electric heater is 250 W or less.

9 Claims, 6 Drawing Sheets

(51) Int. Cl.

| | |
|---|---|
| ***F24F 1/06*** | (2011.01) |
| ***F24F 1/46*** | (2011.01) |
| ***F24F 11/00*** | (2006.01) |
| ***F24F 13/22*** | (2006.01) |

(56) References Cited

U.S. PATENT DOCUMENTS

| | | | | | |
|---|---|---|---|---|---|
| 4,922,728 | A * | 5/1990 | Backus | F25B 47/022 62/239 |
| 8,405,009 | B2 * | 3/2013 | Lim | F25D 21/08 165/62 |
| 2006/0026982 | A1 * | 2/2006 | Yamamoto | B60H 1/00335 62/239 |

FOREIGN PATENT DOCUMENTS

| | | | | | |
|---|---|---|---|---|---|
| JP | 2008-096018 | A | | 4/2008 | |
| JP | 2008096018 | A | * | 4/2008 | F24F 5/00 |
| JP | 2008-286422 | A | | 11/2008 | |
| JP | 2008286422 | A | * | 11/2008 | F25D 21/08 |
| JP | 2010-156515 | A | | 7/2010 | |
| JP | 2010156515 | A | * | 7/2010 | F24F 11/02 |
| JP | 2011-052941 | A | | 3/2011 | |
| JP | 2011-058708 | A | | 3/2011 | |
| JP | 2011052941 | A | * | 3/2011 | F24F 5/00 |
| JP | 2011058708 | A | * | 3/2011 | F24F 11/02 |

OTHER PUBLICATIONS

Lienhard, EPO Search Report, dated Oct. 23, 2015.*

Yokomizo, JPO Notice of Reasons for Rejection, dated Oct. 20, 2015.*

AirMaster Heating & Air, Inc. Blog, "What Are the Pros and Cons of a Heat Pump vs a Gas Furnace?" by Admin dated Jan. 23, 2013, http://www.airmasterheatingandair.com/what-are-the-pros-and-cons-of-a-heat-pump-vs-a-gas-furnace.html.*

Extended European Search Report dated Oct. 23, 2015 in the corresponding EP application No. 14182555.4.

Office Action dated Sep. 21, 2016 issued in corresponding CN patent application No. 201410464925.1 (and English translation).

Office Action dated May 31, 2016 issued in corresponding JP patent application No. 2013-190653 (and English translation).

Office Action dated Oct. 27, 2015 in the corresponding JP application No. 2013-190653 (with English translation).

* cited by examiner

OUTDOOR UNIT AND AIR-CONDITIONING APPARATUS

TECHNICAL FIELD

The present invention relates to an outdoor unit and an air-conditioning apparatus.

BACKGROUND ART

In conventional air-conditioning apparatuses, R22, an HCFC refrigerant or R410A, an HFC refrigerant has been used. However, from viewpoints of protection of the ozone layer and suppression of global warming, attention has recently been paid to substitution with R32, an HFC refrigerant and R290 (propane), an HO refrigerant. The R32 serving as the HFC refrigerant and R290 (propane) of the HO refrigerant have features of considerably lower global warming potentials thereof (hereinafter referred to as GWP) relating to atmospheric release are considerably lower than those of R22, R410A, and the like.

Since the R32 refrigerant, the R290 refrigerant, and so on are flammable, there is a need to design products with sufficient consideration for safety. Since the R32 refrigerant is less flammable than the R290 refrigerant, it allows products to be designed comparatively similarly to nonflammable refrigerants R22 and R410A. However, since the R32 refrigerant is flammable, it is necessary to design products in consideration of safety. For this reason, when a flammable refrigerant is used, the cost is increased to improve safety.

In a typical air-conditioning apparatus, a compression refrigeration cycle is configured by connecting a compressor, an outdoor heat exchanger, an indoor heat exchanger, a pressure reducing device, and so on by a refrigerant pipe. Attempts have been made to use a refrigerant having a low global waving potential to effectively utilize high energy consumption efficiency, which is a characteristic of the refrigeration cycle, and to suppress global warming not only during use but also in disposal of products.

When heating operation is performed in an environment where the outside air temperature is low, such as a cold region and a snowfall region, since the heating operation is continued with increased heating capacity, the outdoor heat exchanger is frosted, and this significantly reduces heat exchange performance. For this reason, defrosting operation is periodically performed to melt frost deposited on the outdoor unit. However, when the outside air temperature is lower than or equal to the freezing point, during defrosting, drain water freezes before being drained outside through a drain outlet provided in a bottom plate of the outdoor unit, and is sometimes not drained normally. Further, if the heating operation with increased heating capacity is continued, the amount of drain water tends to increase during defrosting.

If such a state is repeated for a long time, the area where the drain water freezes extends, and the frozen drain water covers the lower part of the outdoor heat exchanger. If the area is further extended, the refrigerant pipe is broken by the volume expansion effect caused when the drain water in the lower part of the outdoor heat exchanger freezes, and this may cause refrigerant leakage. For this reason, in the regions where the outside air temperature is low, such as the cold region and the snowfall region, the air-conditioning apparatuses, around which the outside air temperature is low, is not so widespread, but there has been a tendency to use burning heating apparatuses that accelerate global warming.

There has been proposed an outdoor unit for an air-conditioning apparatus, in which a bottom plate of the outdoor unit is provided with an electric heater to suppress freezing of the bottom plate (see, for example, Patent Literature 1).

CITATION LIST

Patent Literature

[Patent Literature 1] Japanese Unexamined Patent Application Publication No. 2011-52941 (page 6, FIG. 1)

SUMMARY OF INVENTION

Technical Problem

However, when a flammable refrigerant is used in the air-conditioning apparatus described in Patent Literature 1, if the refrigerant leaks for some reason, the electric heater may become a fire source and ignite the refrigerant. In particular, since the refrigerant is heavier than air, if a refrigerant pipe in an outdoor heat exchanger is broken, the refrigerant may accumulate at the position where the electric heater is stored. If the electric heater is energized in such a state, the temperature of the refrigerant may reach the combustion temperature, and the refrigerant may catch fire. Further, since the electric heater is provided on the bottom plate, the fire is likely to spread outside.

It is conceivable to isolate the electric heater and the outdoor heat exchanger from each other by covering the electric heater with sheet metal so that the electric heater is restricted from becoming the fire source even when the flammable refrigerant is used. However, when the electric heater is covered by sheet metal, freezing of the bottom plate cannot be suppressed. Hence, it is necessary to take other safety measures.

When the outdoor unit is burned by the fire caught from the outside, even if the electric heater is not the fire source, it may be doubted that the electric heater became the fire source and fired the refrigerant. In this case, it is extremely difficult to verify that the outdoor unit was burned by the caught fire. If such erroneous decision is made, the confidence in the manufacturer is significantly reduced, and this is likely to cause huge loss of profits.

When the use of the air-conditioning apparatus using the flammable refrigerant having low GWP is thus promoted for use in wide regions including the cold region in order to suppress global warming, particularly in the cold region and the snowfall region, breakage of the refrigerant pipe and leakage of the flammable refrigerant may be caused by freezing of the outdoor heat exchanger. For this reason, in the air-conditioning apparatus using the flammable refrigerant having low global warming potential, there have been demands to promote spread of the air-conditioning apparatus in the cold region and the snowfall region and to further suppress global warming by ensuring enough heating capacity to be satisfactorily used even in the cold region and the snowfall region and enhancing safety and reliability.

The present invention has been made in view of the above-described problems, and an object of the invention is to obtain an outdoor unit and an air-conditioning apparatus that offer high safety, high reliability, and much comfort, while taking the environmental aspect into consideration.

Solution to Problem

An outdoor unit according to the present invention includes a casing having a bottom plate and configured such that at least a part thereof is made of metal, a compressor provided within the casing to compress a flammable refrigerant, an outdoor heat exchanger provided within the casing to exchange heat between the refrigerant and outside air, and an electric heater provided on an upper surface of the bottom plate. A power consumption of the electric heater is 250 W or less.

An air-conditioning apparatus according to the present invention includes an indoor unit, the outdoor unit of the present invention, and a refrigerant pipe that connects the indoor unit and the outdoor unit.

Advantageous Effects of Invention

According to the present invention, since the electric heater is provided, freezing of drain water can be suppressed. Since the heater capacity of the electric heater is 250 W or less, even if the flammable refrigerant leaks, the electric heater can be restricted from becoming a fire source. Therefore, an outdoor unit and an air conditioning apparatus that offer high safety, high reliability, and much comfort can be obtained while taking the environmental aspect into consideration.

DESCRIPTION OF EMBODIMENTS

Figure 1:
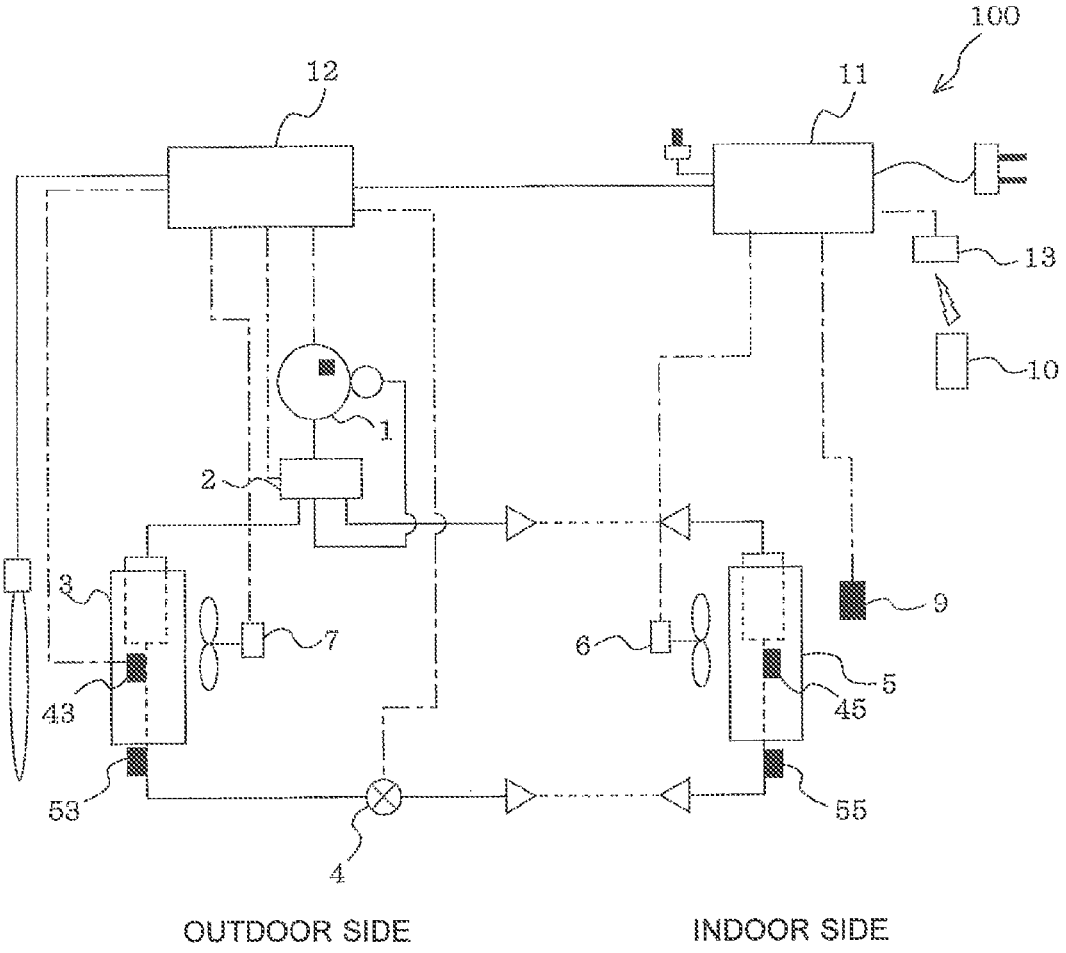
FIG. 1 illustrates the configuration of an air-conditioning apparatus 100 according to Embodiment.

Embodiment of the present invention will be described below with reference to the drawings. In FIG. 1 and subsequent drawings, the dimensional relationships of components are sometimes different from the actual ones. Moreover, in FIG. 1 and the subsequent drawings, components denoted by the same reference numerals correspond to the same or similar components. This is common through the full text of the description. Further, forms of components described in the full text of the description are mere examples, and the components are not limited to the described forms.

The present invention will be described by giving an air-conditioning apparatus 100, in which the rotation speed of a compressor can be changed under inverter control, as an example. FIG. 1 illustrates the configuration of the air-conditioning apparatus 100 according to Embodiment.

As illustrated in FIG. 1, the air-conditioning apparatus 100 includes a compressor 1 for compressing a flammable refrigerant, a four-way valve 2 for switching a refrigerant path, an outdoor heat exchanger 3 for exchanging heat between the refrigerant and outside air, a pressure reducing device 4, an indoor heat exchanger 5, an indoor air-blowing device 6, an outdoor air-blowing device 7, a room temperature sensor 9, an indoor-side controller 11, an outdoor-side controller 12, a light-receiving substrate 13, outdoor-heat-exchanger-side temperature sensors 43 and 53, and indoor-heat-exchanger-side temperature sensors 45 and 55.

The outdoor-heat-exchanger-side temperature sensor 43 is provided within the outdoor heat exchanger 3, and the outdoor-heat-exchanger-side temperature sensor 53 is provided on a side of the outdoor heat exchanger 3 close to the pressure reducing device 4. The indoor-heat-exchanger-side temperature sensor 45 is provided within the indoor heat exchanger 5, and the indoor-heat-exchanger-side temperature sensor 55 is provided on a side of the indoor heat exchanger 5 close to the pressure reducing device 4.

A refrigerant compression cycle of the air-conditioning apparatus 100 is configured by connecting the compressor 1, the four-way valve 2, the outdoor heat exchanger 3, the pressure reducing device 4, and the indoor heat exchanger 5 in a proper order. The outdoor air-blowing device 7 is provided in correspondence to the outdoor heat exchanger 3. The indoor air-blowing device 6 is provided in correspondence to the indoor heat exchanger 5. When the outdoor air-blowing device 7 is operated, air flows from the back side toward the front side of an outdoor unit 50 and passes through the outdoor heat exchanger 3.

In Embodiment, for example, R32 serving as an HFC refrigerant is used. The air-conditioning apparatus 100 of the present invention has a rated cooling capacity of 4.0 kW, a rated heating normal capacity of 5.0 kW, and a rated heating low-temperature capacity of 6.7 kW under the measuring condition based on JIS C 9612.

The room temperature sensor 9 is a sensor that detects the temperature in the room. The light-receiving substrate 13 is a member that transmits signals output from an externally-operated remote control 10 to the indoor-side controller 11. For example, the externally-operated remote control 10 is a device that includes a plurality of operating portions (not illustrated) and that outputs a signal regarding the temperature setting in correspondence to the operated operating portion.

The indoor-side controller 11 detects the building load by calculating the difference between the detected temperature of the room temperature sensor 9 and the setting temperature set through the externally-operated remote control 10. The indoor-side controller 11 is provided on the indoor side, and is electrically coupled to the light-receiving substrate 13. In accordance with the detected building load, the indoor-side controller 11 outputs, to the outdoor-side controller 12, a signal for controlling the rotation speed of the compressor 1, a signal for controlling the four-way valve 2, a signal for controlling the outdoor air-blowing device 7, and a signal for controlling an electric heater 32. The indoor-side controller 11 also controls the indoor air-blowing device 6.

The outdoor-side controller 12 receives information output from the indoor-side controller 11, for example, information about cooling operation and heating operation. On the basis of the information output from the indoor-side controller 11, the outdoor-side controller 12 outputs signals for controlling the compressor 1 (rotation speed of the compressor 1), the four-way valve 2, the outdoor air-blowing device 7, and the electric heater 32 (to be described later).

For example, the indoor-side controller 11 and the outdoor-side controller 12 are formed by hardware, such as circuit devices, which realize these functions or software to be executed on a calculating device such as a microcomputer or a CPU.

An inverter control device for controlling the rotation speed of the compressor 1 and an outdoor-air-blowing-device control device for controlling the outdoor air-blowing device 7 may be provided such that the outdoor-side controller 12 transmits, to the inverter control device, information for controlling the rotation speed of the compressor 1 and transmits, to the outdoor-air-blowing-device control device, information for controlling the outdoor air-blowing device 7. Further, an indoor-air-blowing-device control device for controlling the indoor air-blowing device 6 may be provided such that the indoor-side controller 11 transmits, to the indoor-air-blowing-device control device, information for controlling the indoor air-blowing device 6.

The compressor 1 can be normally rotated at up to 120 Hz, and can be operated at a current of up to 17 A by detecting the current during operation. When the current during operation exceeds 17 A, the outdoor-side controller 12 controls the compressor 1 so as to decrease the rotation speed of the compressor 1.

Figure 2:
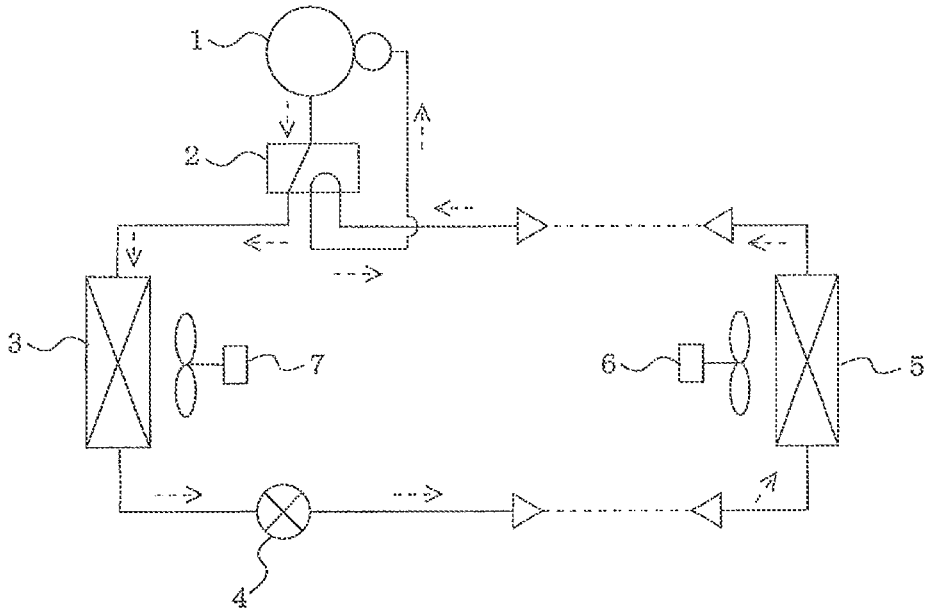
FIG. 2 illustrates a refrigeration cycle during cooling operation in the air-conditioning apparatus 100 of Embodiment.
Figure 3:
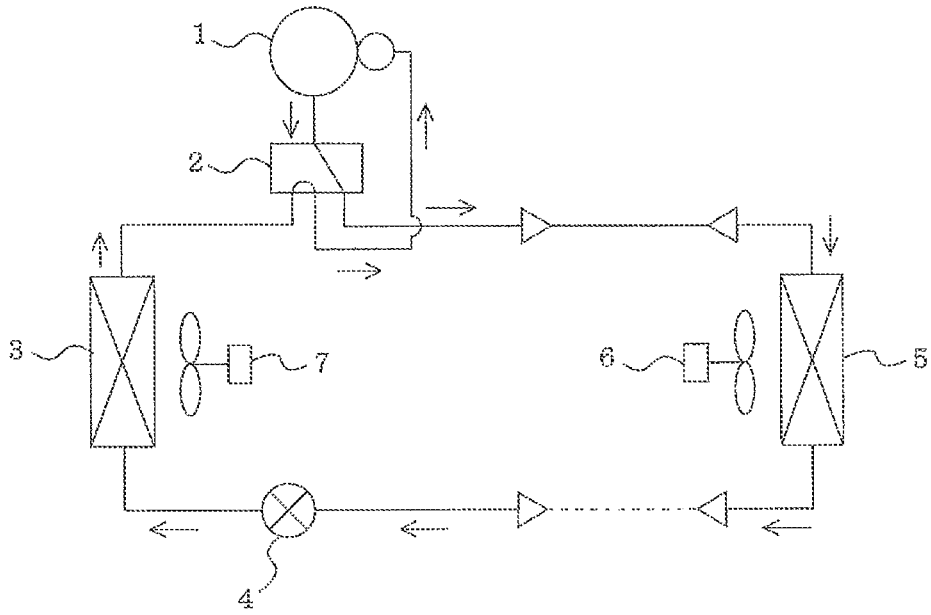
FIG. 3 illustrates a refrigeration cycle during heating operation in the air-conditioning apparatus 100 of Embodiment.

FIG. 2 illustrates a refrigeration cycle during cooling operation of the air-conditioning apparatus 100 according to Embodiment. FIG. 3 illustrates a refrigeration cycle during heating operation of the air-conditioning apparatus 100 according to Embodiment. FIGS. 2 and 3 each illustrate only the refrigeration cycle. As illustrated in FIG. 2, during cooling operation, the outdoor-side controller 12 controls the four-way valve 2 to switch the flow of refrigerant such that the outdoor heat exchanger 3 is used as a condenser and the indoor heat exchanger 5 is used as an evaporator. In contrast, as illustrated in FIG. 3, during heating operation, the outdoor-side controller 12 controls the four-way valve 2 to switch the flow of the refrigerant such that the indoor heat exchanger 5 is used as a condenser and the outdoor heat exchanger 3 is used as an evaporator.

Figure 4:
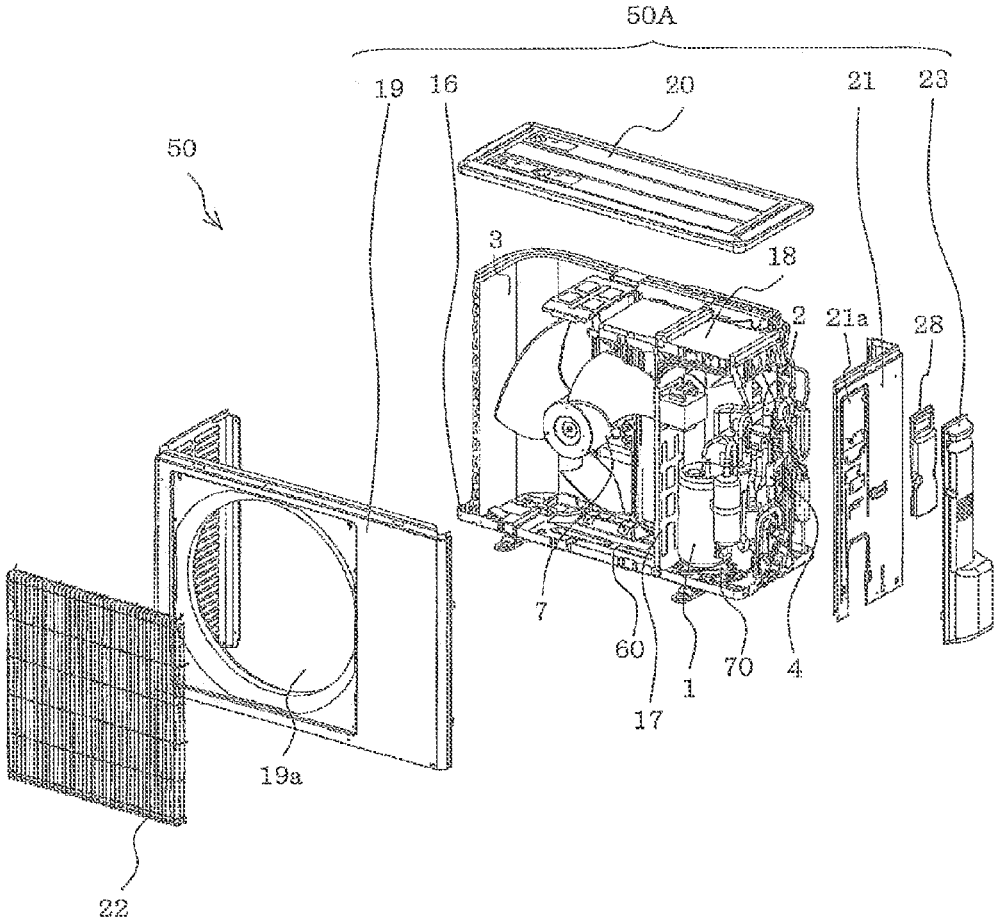
FIG. 4 is an exploded perspective view of an outdoor unit 50 in the air-conditioning apparatus 100 of Embodiment.
Figure 5:
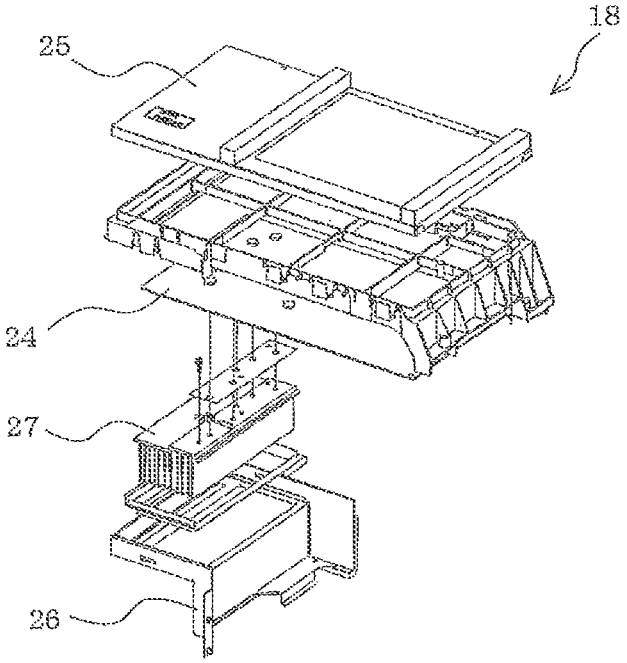
FIG. 5 is an exploded perspective view illustrating the interior of an electric component box 18 in the air-conditioning apparatus 100 of Embodiment.

FIG. 4 is an exploded perspective view of an outdoor unit 50 in the air-conditioning apparatus 100 of Embodiment. FIG. 5 is an exploded perspective view illustrating the interior of an electric component box 18 in the air-conditioning apparatus 100 of Embodiment.

As illustrated in FIG. 4, an outer shell of the outdoor unit 50 is formed by a bottom plate 16, a front panel 19, a top panel 20, a right side panel 21, and a back panel (not illustrated), and these components are collectively called a casing 50A. At least a part of the casing 50A is made of, for example, sheet metal. The structure of the bottom plate 16 will be described later.

For example, the front panel 19 is an L-shaped panel, and forms a front side and a left side of the outer shell of the outdoor unit 50. For example, the front panel 19 has a circular front air outlet 19*a*. The front air outlet 19*a* is an aperture through which air taken into the outdoor unit 50 by operating the outdoor air-blowing device 7 is exhausted outside. A grid-like grille 22 is attached at the front air outlet 19*a*.

The right side panel 21 has an aperture 21*a* through which wires are coupled to a terminal base portion of the electric component box 18. To the right side panel 21, a shielding metal plate 28 is attached to cover the aperture 21*a*. A pipe decorative cover 23 is a member that covers the shielding metal plate 28 and is made of, for example, resin serving as a flame-retardant material. In this way, the electric components are shielded from the outside of the product in all directions by the sheet metal component made of the non-flammable material.

For example, the grille 22 is made of a grille formed by welding vertical and horizontal wires using iron wires as base materials to form a grid and coating the grid with resin. For this reason, the countermeasures against fire spread due to the fire caught from the outside can be stronger than when the grille 22 is made of flame-retardant resin.

A partition plate 17 is provided within the outdoor unit 50. By providing the partition plate 17, the interior of the outdoor unit 50 is divided into an air-blowing device chamber 60 and a machine chamber 70. The outdoor air-blowing device 7 is provided in the air-blowing device chamber 60. The compressor 1, the four-way valve 2, the pressure reducing device 4, and so on are provided in the machine chamber 70. The electric component box 18 is disposed at an upper part of the partition plate 17 to extend in both the machine chamber 70 and the air-blowing device chamber 60. On the back side of the outdoor air-blowing device 7, the outdoor heat exchanger 3 is disposed. The compressor 1 is mounted on the bottom plate 16. The four-way valve 2 and the pressure reducing device 4 are disposed around the compressor 1.

As illustrated in FIG. 5, the electric component box 18 stores various electric components and the like, and for example, stores the outdoor-side controller 12 and a heat sink 27. The heat sink 27 is made of, for example, aluminum, and is attached to the outdoor-side controller 12. The heat sink 27 penetrates a hole (not illustrated) opening in a lower cover 26 from the inside, and is directly exposed to the air-blowing device chamber 60.

In the air-blowing device chamber 60, the electric component box 18 is covered with a top cover 25 and the lower cover 26. In the machine chamber 70, the electric component box 18 is covered with the front panel 19, the top panel 20, and the right side panel 21.

The operation of the air-conditioning apparatus 100 during heating operation will be described below.

When the air-conditioning apparatus 100 performs heating operation, the outdoor heat exchanger 3 functions as an evaporator. At this time, the pressure of the refrigerant decreases, and the temperature of the outdoor heat exchanger 3 decreases. Air sent by the outdoor air-blowing device 7 is cooled by the outdoor heat exchanger 3, and dew condensation water is attached to the outdoor heat exchanger 3.

When the outside air temperature decreases to about 5 degrees C. or less, the temperature of the outdoor heat exchanger 3 becomes negative. Hence, dew condensation water attached to the outdoor heat exchanger 3 freezes into frost, and the outdoor heat exchanger 3 is brought into a frosted state. If the heating operation continues in this state, the outdoor heat exchanger 3 is filled with frost, and this pronouncedly reduces heat exchange performance (evaporation performance during heating operation).

For example, after performing heating operation for about 45 minutes in a low outside-air temperature condition, the outdoor-side controller 12 performs defrosting operation to melt frost deposited on the outdoor heat exchanger 3. The outdoor-side controller 12 determines that the condition is the low outside-air temperature condition when the outdoor-heat-exchanger-side temperature sensor 53 (FIG. 1) detects that the outside air temperature is −3 degrees C. or less.

Embodiment adopts a reverse method in which the outdoor-side controller 12 switches the four-way valve 2 to a cooling operation side so as to deliver heat from the compressor 1 into the outdoor heat exchanger 3 for defrosting operation, as illustrated in FIG. 2.

A description will be given below of a drain path of drain water produced during defrosting operation.

First, the outdoor-side controller 12 switches the four-way valve 2 to the cooling operation side after performing heating operation in a low outside-air temperature condition, and melts frost deposited on aluminum fins of the outdoor heat exchanger 3. Since the heating operation is not performed during the defrosting operation, the indoor air-blowing device 6 and the outdoor air-blowing device 7 are stopped.

When the compressor 1 is operated in this state, the refrigerant is compressed by the compressor 1 into a high-temperature, high-pressure state. The heat quantity is thereby increased, and the frost deposited on the outdoor heat exchanger 3 is melted. The aluminum fins of the outdoor heat exchanger 3 are subjected to hydrophilic coating, and the bottom plate 16 has a given slope toward a drain outlet 30. For this reason, water produced by melting the frost flows along the surfaces of the aluminum fins of the outdoor heat exchanger 3, is guided to the bottom plate 16 of the outdoor unit 50 from a lower part of the outdoor heat exchanger 3, and is drained out of the outdoor unit 50 through the drain outlet 30.

When the temperature of a pipe temperature sensor 31 in the outdoor heat exchanger 3 increases by 3 degrees C. or more, the outdoor-side controller 12 determines that the defrosting operation has been completed, and finishes the defrosting operation. The defrosting operation normally finishes in about 3 to 5 minutes, although according to the amount of frost. After the defrosting operation is finished, the outdoor-side controller 12 switches the four-way valve 2 to the heating operation side again, and performs heating operation illustrated in FIG. 3.

In a cold region where the outside aft temperature frequently becomes 0 degrees C. or less, drain water produced by defrosting operation may freeze between the lower part of the outdoor heat exchanger 3 and the drain outlet 30 of the bottom plate 16, and this may cause drainage failure. If the defrosting operation is repeated in this state, ice formed by freezing of the drain water accumulates from the lower part of the outdoor heat exchanger 3 onto the bottom plate 16. Finally, the ice formed by freezing of the drain water is formed in the part corresponding to the refrigerant pipe in the lower portion of the outdoor heat exchanger 3. This ice covers a lower portion of several centimeters of the outdoor heat exchanger 3.

If the defrosting operation is performed in this state, only ice around the refrigerant pipe melts, but not the whole part of the ice covering the lower part of the outdoor heat exchanger 3 is completely melted. For this reason, the change from ice to water and the change from water to ice are repeated in a narrow area around the pipe. The refrigerant pipe is crushed by a volume expansion effect caused when water is turned into ice, and is finally broken.

If the refrigerant pipe is broken, the flammable refrigerant sealed in the refrigerant circuit is released to the atmosphere. The flammable refrigerant released to the atmosphere may burn when a fire source exists therearound in a flammable concentration state. For this reason, operating the air-conditioning apparatus in the cold region has a safety problem.

Particularly in the case of home air-conditioning apparatuses (air conditioners), it is difficult to confine, by a specific limitation, the regions to which such air-conditioning apparatuses are sold, or limit the installation destinations thereof, and the use of the air-conditioning apparatuses in the cold region cannot be restricted. Hence, it is difficult to widely spread air-conditioning apparatuses using a flammable refrigerant. Accordingly, Embodiment uses an electric heater 32, which will be described with reference to FIG. 7 and subsequent drawings, to suppress freezing of drain water produced by defrosting operation.

Figure 6:
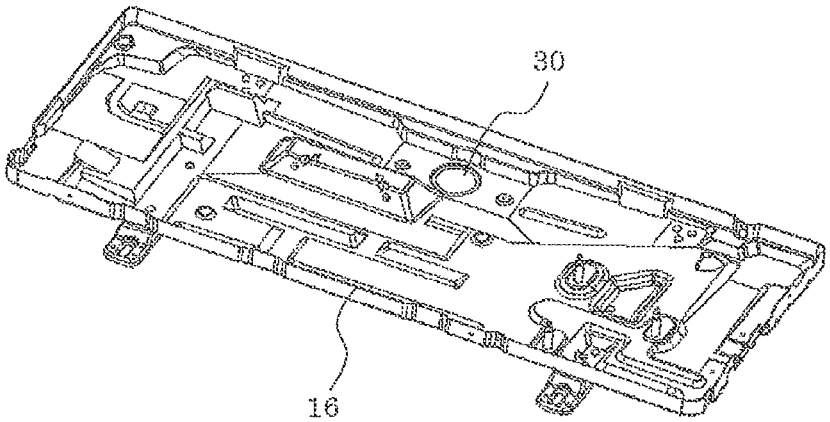
FIG. 6 is a perspective view of a bottom plate 16 in the air-conditioning apparatus 100 of Embodiment.
Figure 7:
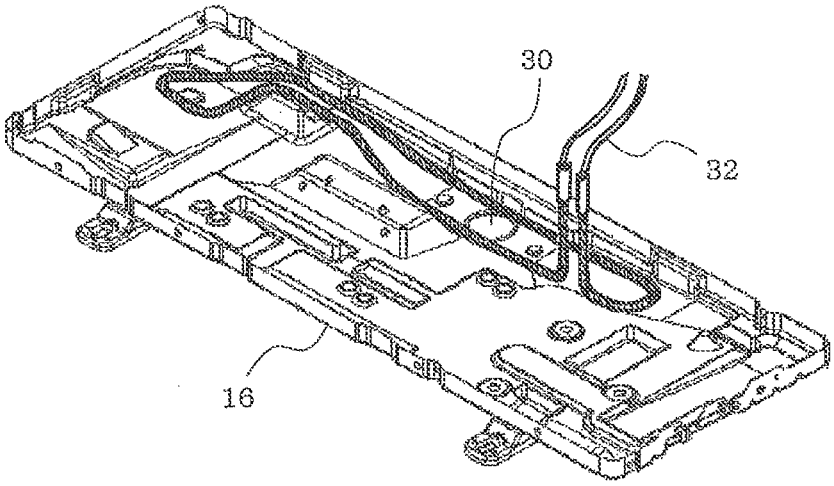
FIG. 7 is a perspective view of an electric heater 32 on the bottom plate 16 in the air-conditioning apparatus 100 of Embodiment.
Figure 8:
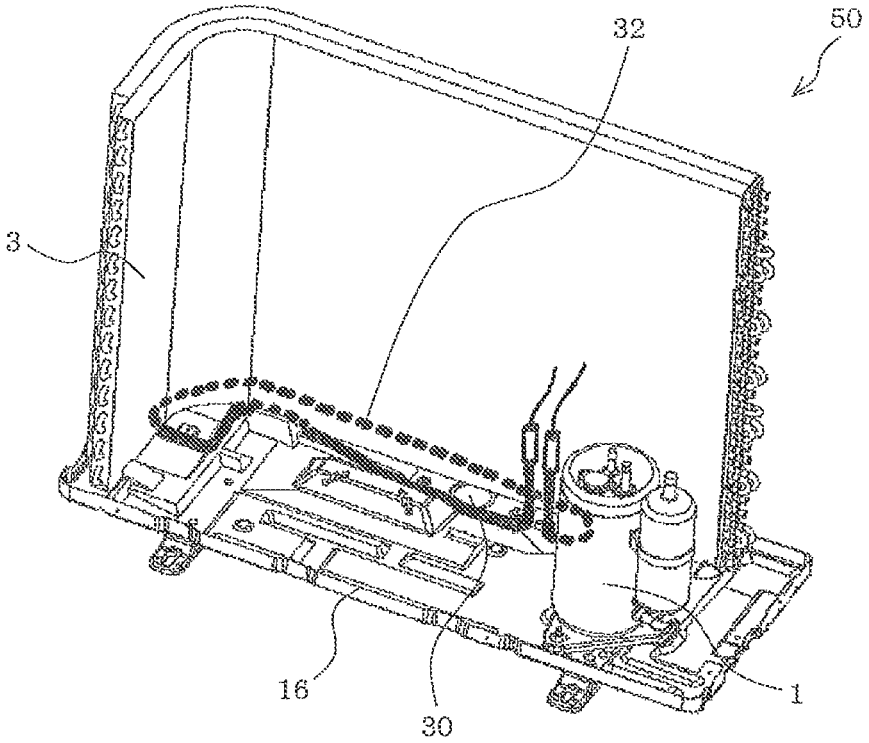
FIG. 8 is a perspective view illustrating an outdoor heat exchanger 3 and the bottom plate 16 in the air-conditioning apparatus 100 of Embodiment.

FIG. 6 is a perspective view of the bottom plate 16 in the air-conditioning apparatus 100 of Embodiment. FIG. 7 is a perspective view of the bottom plate 16 and the electric heater 32 in the air-conditioning apparatus 100 of Embodiment. FIG. 8 is a perspective view illustrating the outdoor heat exchanger 3 and the bottom plate 16 in the air-conditioning apparatus 100 of Embodiment.

As illustrated in FIG. 6, the bottom plate 16 has the drain outlet 30. As illustrated in FIGS. 7 and 8, the electric heater 32 is provided on the upper surface of the bottom plate 16. The electric heater 32 is bent in a U-shape along the outdoor heat exchanger 3. For this reason, the total length of the electric heater 32 is preferably designed to be more than or equal to the length of the outdoor heat exchanger 3. The electric heater 32 serves to suppress freezing of drain water, and is formed by, for example, a sheath heater having a comparatively small heater capacity. By thus providing the electric heater 32, ice produced by freezing of the drain water is not formed in the path extending from the bottom plate 16 to the drain outlet 30.

The electric heater 32 is preferably provided within a range at a distance of 5 cm or less from the outdoor heat exchanger 3 such that the drain water does not freeze in the lower part of the outdoor heat exchanger 3. Further, the length of the electric heater 32 is preferably more than or equal to ½ of the length of the outdoor heat exchanger 3. This can further suppress freezing in the lower part of the outdoor heat exchanger 3.

When defrosting is performed during heating operation and the outdoor-heat-exchanger-side temperature sensor 53 detects that the condition is the low outside-air temperature condition, the outdoor-side controller 12 energizes the electric heater 32 in heating operation including defrosting operation. Since the defrosting operation is performed when the outside air temperature becomes lower than or equal to about 3 degrees C., the time of energization of the electric heater 32 is limited, and this can reduce the power consumption of the user. Further, the electric heater 32 can be restricted from being superheated by the rise of the outside air temperature from a high temperature state.

Since the energization rate of the electric heater 32 becomes low, the possibility that the electric heater 32 will become a fire source can be reduced when the refrigerant leaks in an abnormal state. Further, particularly when the refrigerant is a mildly flammable refrigerant, the refrigerant leaking from the outdoor heat exchanger 3 is diffused to the outside when the outdoor air-blowing device 7 rotates. Hence, the refrigerant rarely reaches the flammable concentration. The probability that the refrigerant accumulates is high during stoppage of the air-conditioning apparatus 100 in which the outdoor air-blowing device 7 continues stopping. A conceivable case as a similar condition is such that the installation worker erroneously leaks the refrigerant, for example, when additionally sealing the refrigerant by using a service refrigerant cylinder at the time of installation of the air-conditioning apparatus 100.

In consideration of such a situation, the outdoor-side controller 12 performs control such as to start the operation of the air-conditioning apparatus 100 and to energize the electric heater 32 after the outdoor air-blowing device 7 is operated for a fixed time. Here, for example, the fixed time is ten seconds.

In Embodiment, an electric heater having a comparatively small heater capacity and a power consumption of 250 W or less is used as the electric heater 32. On the assumption of an abnormal state of the electric heater 32, a test regarding the increase in temperature of the bottom plate 16 was conducted in a state in which the electric heater 32 having a power consumption of 250 W was disposed along the lower part of the outdoor heat exchanger 3. The upper limit of increased temperature of the bottom plate 16 was 200 degrees C. or less.

The ignition temperature of the R32 refrigerant used in the air-conditioning apparatus 100 requires a heat energy of 700 degrees C. or more. Alternatively, the ignition point of propane is about 430 degrees C. When it is assumed that wood or the like is mixed within the outdoor unit 50, the ignition temperature of the wood is about 260 degrees C.

When the electric heater 32 having the power consumption of 250 W is thus used, the temperature of the bottom portion of the outdoor unit 50 becomes about 200 degrees C. or less. For this reason, for example, even when the R32 refrigerant is used or wood is mixed in the outdoor unit 50, the electric heater 32 can be restricted from becoming the fire source. That is, the electric heater 32 having the power consumption of 250 W has sufficient safety.

By using the sheath heater as the electric heater 32, the shape of the electric heater 32 can be freely bent to a certain degree. This allows the electric heater 32 to be fixed and more easily stored at a designated position, and can enhance productivity of the air-conditioning apparatus 100.

Next, the heating capacity will be described. The dimensions of the room to which various heaters, including an air-conditioning apparatus, are applied are selected in accordance with the rated capacity. For example, a burning heating apparatus can show its heating capacity without any influence of outside air. In contrast, an air-conditioning apparatus using a refrigeration cycle adopts a heat pump method that carries heat from the outside air into the room, and therefore, in principle, the maximum capacity that the apparatus can show decreases as the outside air temperature decreases. For this reason, air-conditioning apparatuses are not spread particularly in the cold region. However, if the air-conditioning apparatus 100 using the flammable refrigerant can be developed in a wide region, it is utilized as an alternative heating apparatus to the burning heating apparatus and can greatly contribute to suppression of global warming. For that purpose, the heating capacity needs to be set for regions including the cold region.

In recent years, the maximum heating capacity greater than or equal to the rated capacity has been exercised by using a rotation-speed control (inverter driven) compressor. For this reason, an air-conditioning apparatus uninfluenced by the outside air temperature, similarly to the burning heating apparatus, can be obtained by setting the maximum heating capacity in consideration of a decrease in capacity due to the outside air temperature. That is, it is possible to configure an air-conditioning apparatus that can be sufficiently used even in the cold region. The following description will be given of the maximum heating capacity required to configure the air-conditioning apparatus uninfluenced by the outside air temperature.

When the national average temperature of Japan is given as an example, the time in which the outside air temperature is −7 degrees C. or less is 5% or less in the heating season, and this is considerably short. This is the reason why the heating very low temperature condition is set at −7 degrees C. in JIS C 9612. The heating very low temperature condition is also set at −7 degrees C. or less in the international standard. In the context of these, as long as an air-conditioning apparatus can show the rated heating capacity at up to −7 degrees C., it can be regarded as an air-conditioning apparatus that is rarely influenced by the outside air temperature.

While the rated heating capacity is set with reference to an outside temperature of 7 degrees C. (heating normal condition) in JIS C 9612 (JIS for the room air conditioner), if the outside air temperature decreases to −7 degrees C. when the rotation speed of the compressor 1, the rotation speed of the air-blowing fan, and so on remain in this state, the capacity generally decreases to 64% of the rated heating capacity. Therefore, as long as the maximum heating capacity of the air-conditioning apparatus has a likelihood of about 1.56 times the rated capacity in the heating normal condition where the outside air is 7 degrees C., the air-conditioning apparatus can be regarded uninfluenced by the outside air temperature even in the cold region.

When the capacity similar to this is expressed as the heating low-temperature capacity at an outside air temperature of 2 degrees C. serving as the measuring condition in JIS C 9612, it is only necessary that the heating low-temperature capacity should be set at about 1.3 times the rated capacity. For this reason, the heating low-temperature capacity of the air-conditioning apparatus according to the present invention is set at 1.3 or more times the rated capacity. Therefore, the air-conditioning apparatus can show high heating capacity.

In this way, the air-conditioning apparatus using the flammable refrigerant needs to show high heating capacity to be applied to the wide region including the cold region. However, as the shown heating capacity increases, the amount of drain water during defrosting operation increases. In a low outside air temperature condition, the drain water is likely to freeze and to cause drainage failure.

In contrast, the outdoor unit 50 of Embodiment includes the casing 50A that has the bottom plate 16 and configured such that at least a part thereof is made of metal, the compressor 1 provided within the casing 50A to compress the flammable refrigerant, the outdoor heat exchanger 3 provided within the casing 50A to exchange heat between the refrigerant and outside air, and the electric heater 32 provided on the upper surface of the bottom plate 16. The power consumption of the electric heater 32 is 250 W or less. For this reason, even if the flammable refrigerant leaks, the electric heater 32 can be restricted from becoming a fire source because the heater capacity of the electric heater 32 is 250 W or less. Therefore, it is possible to obtain an outdoor unit and an air-conditioning apparatus that offer high safety, high reliability, and much comfort, while taking the environmental aspect into consideration.

By providing the electric heater 32, freezing of the drain water can be suppressed. By making at least a part of the casing 50A of metal, the possibility that thermal deformation and degradation of resin will be promoted can be made lower than when the outer shell component is made of resin. When the cause of ignition is investigated later, it is easy to verify that fire did not occur from the air-conditioning apparatus 100 itself. In particular, this is effective, for example, in the case, even in the condition where the outside air temperature is low, when the outside air humidity is low, drain water does not accumulate on the bottom plate 16 and heat of the electric heater 32 is transferred to the outer shell component without being cooled.

Since the electric component box 18 is shielded from the outside by the metal partition plate, even if fire spreads owing to the catch of fire from the outside of the air-conditioning apparatus, the outdoor unit 50 itself is restricted from being burned completely. For this reason, when the cause of ignition is investigated later, it is easy to verify that the fire did not occur from the air-conditioning apparatus 100 itself.

The outdoor-side controller 12 energizes the electric heater 32 after the air-conditioning apparatus 100 starts and the outdoor air-blowing device 7 rotates to release the accumulated refrigerant to the outside by air sending. For this reason, at start-up of the air-conditioning apparatus 100 when there is a high possibility that the refrigerant accumulates at high concentration and the concentration reaches the flammable concentration, even if the outdoor heat exchanger 3 breaks and leakage of the refrigerant occurs, ignition does not occur because the electric heater 32 is not energized. For this reason, ignition can be reduced.

As a measure of use of the air-conditioning apparatus as a heating apparatus in the cold region and the snowfall region, it is preferable to exercise a capacity higher than or equal to the rated heating capacity of the apparatus at an outside air temperature of 7 degrees C. in the heating very low temperature condition, where the outside air temperature is −7 degrees C., specified by JIS B 8615 and JIS C 9612.

For example, in Japan, the time in which the outside air temperature becomes lower than or equal to −7 degrees C. is less than 5% even in the heating season. For this reason, as long as the apparatus can show a heating capacity more than or equal to the rated heating capacity, which ensures the capacity of the apparatus, under the condition at an outside air temperature of −7 degrees C., it can be used in a wide region including the cold region. When the capacity is replaced with the capacity at an outside air temperature of 2 degrees C. in the meaning similar to this, it is only necessary that the rated heating low-temperature capacity at the outside air temperature of 2 degrees C. should be more than or equal to 1.3 times the rated heating normal capacity at an outside air temperature of 7 degrees C.

Examples of alternative refrigerants to R22 serving as a hydrochlorofluorocarbon (HCFC) refrigerant and R410A serving as a hydrofluorocarbon (HFC) refrigerant are R32 (difluoromethane) serving as a flammable HFC refrigerant with low global warming potential, a hydrofluoroolefin refrigerant (for example, HFO1234yf, HFO1234ze), and a mixed refrigerant of R32 and HFO.

For example, these refrigerants are flammable, but are mildly flammable. The refrigerants are ignited only when the concentration and ignition energy are higher than, for example, those of R290 (propane) serving as an HC refrigerant. Hence, an apparatus configuration similar to that of the present invention can be obtained by taking given safety measures to a conventional air-conditioning apparatus using an R22 refrigerant or an R410A refrigerant. For this reason, it is possible to take safety measures while limiting the input cost to a comparatively low value, and to widely spread the use of apparatus.

Figure 9:
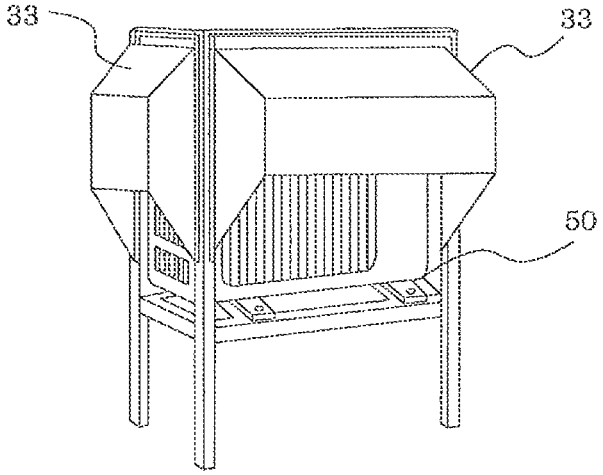
FIG. 9 is a perspective view of hoods 33 in the air-conditioning apparatus 100 of Embodiment.

FIG. 9 is a perspective view of hoods 33 of the air-conditioning apparatus 100 according to Embodiment. As illustrated in FIG. 9, a snow-protection hood 33 may be provided at the front air outlet 19*a*. Further, a snow-protection hood may be provided at a back air inlet (not illustrated) formed in an unillustrated back panel. Alternatively, a snow-protection hood may be provided at at least any of the front air outlet 19*a* and the back air inlet.

In this way, in the air-conditioning apparatus 100 of Embodiment, acceleration of freezing of the bottom plate 16 due to entry of snow from the front air outlet 19*a* and shortage of defrosting capacity due to the increase in amount of frost formed on the outdoor heat exchanger 3 can be suppressed particularly when the amount of snowfall is large in the snowfall region. That is, the proof strength for suppressing freezing of the outdoor heat exchanger 3 is increased. Therefore, the effect of the electric heater 32 can be increased further.

REFERENCE SIGNS LIST

1: compressor, 2: four-way valve, 3: outdoor heat exchanger, 4: pressure reducing device, 5: indoor heat exchanger, 6: indoor air-blowing device, 7: outdoor air-blowing device, 9: room temperature sensor, 10: externally-operated remote control, 11: indoor-side controller, 12: outdoor-side controller, 13: light receiving substrate, 16: bottom plate, 17: partition plate, 18: electric component box, 19: front panel, 19*a*: front air outlet, 20: top panel, 21: right side panel, 21*a*: aperture, 22: grille, 23: pipe decorative cover, 25: top cover, 26: lower cover, 27: heat sink, 28: shielding metal plate, 30: drain outlet, 31: pipe temperature sensor, 32: electric heater, 33: hood, 43, 53: outdoor-heat-exchanger-side temperature sensor, 45, 55: indoor-heat-exchanger-side temperature sensor, 50: outdoor unit, 50A: casing, 60: air-blowing device chamber, 70: machine chamber, 100: air-conditioning apparatus.

The invention claimed is:

1. An outdoor unit comprising:

a casing having a bottom plate and at least a part of the casing is made of metal;

a compressor provided within the casing and configured to compress a flammable refrigerant contained within the compressor;

an outdoor heat exchanger provided within the casing and configured to exchange heat between the refrigerant and outside air; and an electric heater provided on an upper surface of the bottom plate, the electric heater having a power consumption of 250 W or less and being configured to:

transfer heat to drain water accumulated on the bottom plate of the casing and suppress freezing of the accumulated drain water, and transfer heat to the metal part of the casing where no drain water s accumulated on the bottom plate of the casing.

2. The outdoor unit of claim 1, wherein an electric component box that is made of metal and stores a terminal base and an electronic substrate is provided within the casing.

3. The outdoor unit of claim 1, further comprising:

an outdoor air-blowing device, wherein the electric heater is energized after the outdoor air-blowing device starts rotating.

4. The outdoor unit of claim 1, wherein the electric heater is a sheath heater.

5. The outdoor unit of claim 1, wherein a rated heating low-temperature capacity at an outside air temperature of 2 degrees C. is more than or equal to 1.3 times a rated heating normal capacity at an outside air temperature of 7 degrees C.

6. The outdoor unit of claim 1, wherein a front side of the casing has a front air outlet, wherein a back side of the casing has a back air inlet, and wherein a hood is provided to cover at least one of the front air outlet and the back air inlet.

7. An air-conditioning apparatus comprising:

an indoor unit:

an outdoor unit including:

a casing having a bottom plate and at least a part of the casing is made of metal;

a compressor provided within the casing and configured to compress a flammable refrigerant contained within the compressor;

an outdoor heat exchanger provided within the casing to exchange heat between the refrigerant and outside air;

an electric heater provided on an upper surface of the bottom plate, the electric heater having a power consumption of 250 W or less and being configured to:

transfer heat to and suppress freezing of drain water accumulated on the bottom plate of the casing, and transfer heat to the metal part of the casing where no drain water is accumulated on the bottom plate; and a refrigerant pipe that connects the indoor unit and the outdoor unit.

8. An outdoor unit of claim 1, wherein the bottom plate includes the part of the casing made of metal and the bottom plate is configured to cooperate with the electric heater to suppress freezing of the drain water accumulated on the bottom plate.

9. An air-conditioning apparatus of claim 7, wherein the bottom plate includes the part of the casing made of metal and the bottom plate is configured to cooperate with the electric heater to suppress freezing of the drain water accumulated on the bottom plate.

* * * * *